United States Patent [19]

Dreker et al.

[11] 4,102,138

[45] Jul. 25, 1978

[54] METHOD FOR CLOSING OFF A MINE GALLERY ESPECIALLY FOR USE TO PREVENT SPREADING OF UNDERGROUND EXPLOSIONS

[75] Inventors: Raimund Dreker, Essen; Gerhard Endras, Augsburg; Bernhard Langerbein, Lünen, all of Fed. Rep. of Germany

[73] Assignee: Bergwerksverband GmbH, Essen, Fed. Rep. of Germany

[21] Appl. No.: 772,631

[22] Filed: Feb. 28, 1977

Related U.S. Application Data

[62] Division of Ser. No. 585,806, Jun. 11, 1975, Pat. No. 4,036,024.

[30] Foreign Application Priority Data

Jun. 12, 1974 [DE] Fed. Rep. of Germany ..... 2428290

[51] Int. Cl.[2] ..... E21F 5/00

[52] U.S. Cl. ..... 61/42; 299/12

[58] Field of Search ..... 49/31; 61/3, 35, 42, 61/45 R, 45 F; 299/11, 12

[56] References Cited

U.S. PATENT DOCUMENTS

| | | | |
|---|---|---|---|
| 3,504,497 | 4/1970 | Turzillo | 61/35 |
| 3,518,834 | 7/1970 | Gnaedinger et al. | 61/42 X |
| 3,750,407 | 8/1973 | Heierli et al. | 61/42 |
| 3,831,318 | 8/1974 | Richmond | 49/31 |
| 3,886,751 | 6/1975 | Labora | 61/3 |

*Primary Examiner*—Paul R. Gilliam
*Assistant Examiner*—David H. Corbin
*Attorney, Agent, or Firm*—Michael J. Striker

[57] ABSTRACT

A device for closing off a mine gallery, especially for use to prevent spreading or underground explosions, in which a bag of flexible substantially airtight material is first inflated with a gas under pressure, for instance air, until the inflated bag engages with its peripheral surface the inner face of the mine gallery, whereafter a flowable material is pumped into the interior of the bag, displacing the gas under pressure, which is permitted to escape through at least one overpressure valve provided in an uppermost portion of the inflatable bag. The material to be pumped into the interior of the bag is of a nature which quickly hardens after being pumped into the bag to thus provide a solid barrier extending across the mine gallery.

4 Claims, 2 Drawing Figures

METHOD FOR CLOSING OFF A MINE GALLERY ESPECIALLY FOR USE TO PREVENT SPREADING OF UNDERGROUND EXPLOSIONS

This is a division of application Ser. No. 585,806 filed June 11, 1975 now U.S. Pat. No. 4,036,024.

BACKGROUND OF THE INVENTION

The present invention relates to a bag inflatable by gas under pressure and fillable with a liquid for closing off a mine gallery, especially for use to prevent spreading of underground explosions, in which the bag after inflation has a cylindrical or half cylindrical cross section with curved end faces and is provided at an upper portion thereof with an overpressure valve and on one end face thereof with tubes communicating with the interior of the bag for filling the latter with the pressure gas, respectively the liquid.

Flexible bags to be filled with water or other fire extinguishing fluids to provide the miners with a preliminary protection during suddenly occurring underground fires or explosions are already known from the German Offenlegungsschrift No. 2,136,346. Such bags filled with liquid act during an explosion against the dynamic explosion pressure and reduce, as experiments have shown, the explosion pressure wave practically to zero. This, however, necessarily leads to a bursting of a bag. The quenching liquid emanating from the bursting bag will cool the explosion flame, however, this will not completely exclude that the miners will be exposed to subsequent explosions.

Explosion-resistant dams which consist of wooden sheeting which is filled with a quickly hardening solid material are also already known. Due to their high weight, they are adapted to withstand explosions. The necessary time for erecting such dams is, however, considerable and this may entail that during rapid spread of an underground fire, whole sections of a mine gallery will have to be abandoned.

SUMMARY OF THE INVENTION

It is an object of the present invention to further develop inflatable bags of the above-described type in such a manner that they can be used as explosion-resistant dams which can be quickly erected to prevent spread of an underground explosion or spread of a fire in a mine gallery.

With this and other objects in view, which will become apparent as the description proceeds, the present invention relates to a device for closing off a mine gallery, especially for use to prevent spread of underground explosions, which mainly comprises an inflatable bag of flexible substantially airtight material having, when inflated, a substantially cylindrical or semicylindrical peripheral surface adapted to engage the inner face of a mine gallery and curved end faces, conduit means communicating with the interior of the bag to inflate the latter first with gas under pressure and to fill the bag subsequently thereto with flowable material which hardens after being filled into the bag, and at least one overpressure valve in an uppermost portion of the bag for discharge of the pressure gas during filling the bag with the hardenable material.

By the use of the hardenable material, the thus filled bag will constitute an explosion-resistant dam providing a permanent protection for the miners. Furthermore, such explosion-resistant dams can be erected within a relatively small period of time.

The bag filled with the solid material can, in a known manner, be sealed in the mine gallery by pressing sealing material into any clearance between the filled bag and the surrounding rock of the mine gallery. Preferably, however, the peripheral surface of the bag is constructed in such a manner to provide, substantially midway between the end faces thereof, a constriction extending around the whole circumference, and one or more filling conduits are provided in the bag communicating with the annular space formed between the constriction and the surrounding rock through which a likewise hardenable material is then pumped in this annular space. In this way a perfect seal is obtained around the peripheral surface of the bag, which will assure a perfect interlocking between the bag and the surrounding rock. The thus-erected dam is adapted, due to its considerable weight and due to the interlocking with the surrounding rock, to properly resist any occurring explosion pressures.

The inflatable bag may also be provided with a crawl tube extending horizontally through the bag and the end faces thereof to provide access to the side of the bag on which a fire may exist in the mine gallery, and, of course, this tube is provided with a cover for closing the same when desired. Laterally of the bag there may be provided a snifting tube in order to extract some gas samples from one side of the dam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
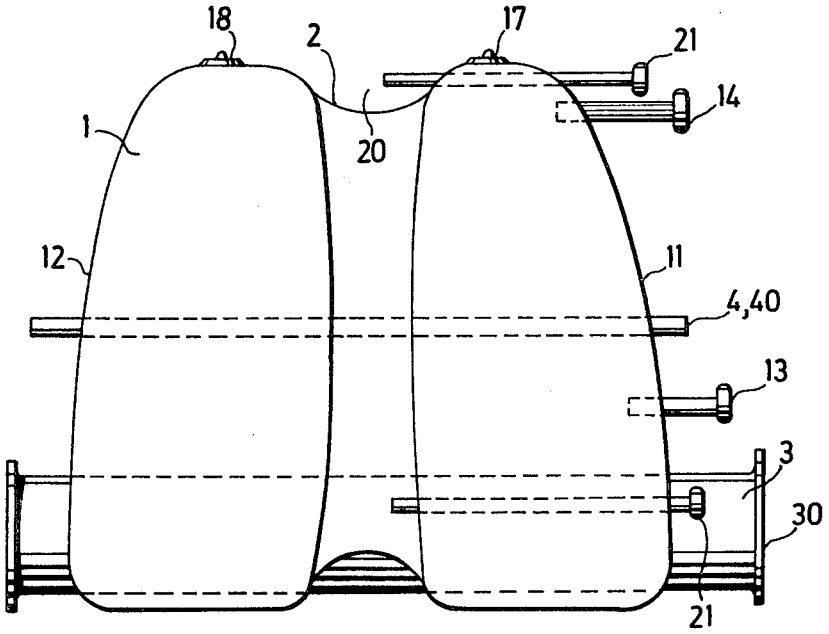
FIG. 1 is a side view of the bag according to the present invention in inflated condition.
Figure 2:
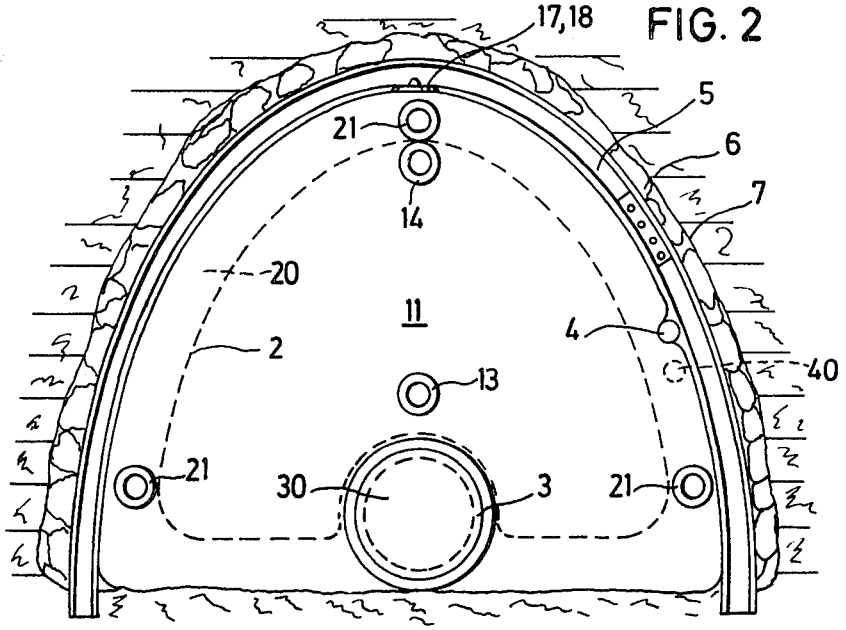
FIG. 2 is an end view of the bag in inflated condition and showing the surrounding rock of a mine gallery.

As shown in the two Figures of the drawing, the inflatable bag 1 according to the present invention, formed from flexible substantially airtight material, has, in inflated condition, a substantially half-cylindrical cross section, a curved front face 11 and a curved rear face 12. The bag may be formed from a fabric of polyester provided on opposite faces with layers of neoprene fixed thereto. Conduit means in form of filling tubes 13 and 14, communicating with the inner ends thereof with the interior of the bag, extend through the front face 11 securely fastened thereto in any known manner. In the uppermost portions of the bag, when inflated, two overpressure valves 17 and 18 are provided. The peripheral surface of the bag is constructed in such a manner to provide, when the bag is inflated, an annular constriction 2. In the thus formed annular space between the constriction 2 and the surrounding rock lead a plurality of filling tubes 21 extending through the corresponding portion of the bag and fixedly secured thereto in any known manner. These filling tubes 21 are arranged, as best shown in FIG. 2, substantially at corners of a triangle having an apex in the upper region of the inflated bag. A crawl tube 3 is provided in the region of the sole of the bag to provide access to the side thereof at which a fire may be raging. At least one end of the tube 3 is closed by a cover 30 releasably connected to this end in any convenient manner. A snifting tube 4 extending with opposite ends beyond the front face 11 and the rear face 12 may be connected to the peripheral surface of the bag substantially midway between the bottom and the top thereof, or a snifting tube 14 may extend longitudinally through the bag and connected to the faces 11 and 12 in any well known conventional manner for extracting gas samples from the side of the bag rearwardly of the rear face 12 thereof.

The above-described device is used as follows:

The bag 1 is first inflated with air at an overpressure of about 500 mm water column through the conduit 13 from a supply of air under pressure (not shown) in order to expand the bag against the mine supports 5 and the surrounding rock 6. Subsequently thereto a flowable material is pumped through the conduit 14 by means of a pump (not shown) under a pressure greater than the pressure of the air in the bag into the latter, displacing the air which escapes through the overpressure valves 17 and 18, until the complete interior of the bag is filled with this material. The material to be pumped into the bag is of a nature which hardens quickly after being filled into the interior of the bag, and such material may, for instance, consist of formable and hardenable plastic material such as polyurethane resin produced from polyolalcohol and polyisocyanate and an addition of water; unsaturated polyester resin foamable by an addition of isocyanate; foamable urea formaldehyde condensation resins, respective phenol-formaldehyde condensation products; or hydraulic cements, such as a hydraulic cement brought on the market in Germany under the tradename Blitzdammer C and consisting of 50% per weight of cement clinker, 40% by weight lime marl, 9.5% per weight calcium chloride and 0.5% per weight lightly burned Lepol kiln clinker; or special gypsum for mines consisting of 50% per weight of burned limestone and 50% per weight of burned lime marl. The above hydraulic cements are, shortly before they are pumped into the interior of the bag, mixed with water to make a slurry therefrom.

Since some clearance will remain between the thus filled bag 1 and the surrounding rock 7, a slurry of solid material, such as for instance a slurry of the same material as is mentioned above, is pumped in the annular space 20 to obtain thereby a tight sealing of the inflated bag and the surrounding rock 7.

It will be understood that each of the elements described above, or two or more together, may also find a useful application in other types of devices for closing off a mine gallery differing from the type described above.

While the invention has been illustrated and described as embodied in a device for closing off a mine gallery, especially for use to prevent spreading of underground explosions, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of closing off the passage through a mine gallery, comprising the steps of placing an inflatable bag into the open passage of the mine gallery; inflating the bag with gas under pressure until the inflated bag extends transversely through said passage and engages with the peripheral surface thereof the inner surface of the mine gallery to completely seal the passage; subsequently pumping into the bag a flowable material which quickly hardens after being filled into the bag while permitting at the same time the gas to escape from the interior of the bag through an overpressure valve arranged at the highest point of the inflated bag, until the bag is completely filled with said hardenable material to thus form, after hardening of the material, a solid wall extending across the passage of the mine gallery in engagement with the inner surface of the latter.

2. A method as defined in claim 1, wherein the material to be pumped into the inflated bag is selected from the group consisting of foamable hardenable plastic material and a slurry of hydraulic cement.

3. A method as defined in claim 1, wherein said bag is constructed to have, when inflated, an annular constriction substantially midway in its peripheral surface defining with the surrounding rock of the mine gallery an annular space, and including the step of filling the space, subsequently to filling the interior of the bag, with a flowable material which hardens after being filled into said space so as to securely anchor the filled bag in the surrounding rock of the mine gallery.

4. A method as defined in claim 3, wherein the material for filling said annular space is selected from the group consisting of foamable hardenable plastic material and a slurry of hydraulic cement.

* * * * *